US007267064B2

(12) United States Patent
Perale et al.

(10) Patent No.: US 7,267,064 B2
(45) Date of Patent: Sep. 11, 2007

(54) HARNESS SUITABLE FOR USE ON WATERCRAFT

(75) Inventors: Giuseppe Perale, Milan (IT); Alessandro Tedesco, Monza (IT)

(73) Assignee: Politecnico di Milano, Milan (IT)

( * ) Notice: Subject to any disclaimer, the term of this patent is extended or adjusted under 35 U.S.C. 154(b) by 0 days.

(21) Appl. No.: 10/528,045

(22) PCT Filed: Sep. 12, 2003

(86) PCT No.: PCT/EP03/10198

§ 371 (c)(1),
(2), (4) Date: Mar. 16, 2005

(87) PCT Pub. No.: WO2004/026678

PCT Pub. Date: Apr. 1, 2004

(65) Prior Publication Data

US 2006/0005754 A1 Jan. 12, 2006

(30) Foreign Application Priority Data

Sep. 17, 2002 (IT) ..... MI2002A1970

(51) Int. Cl.
*B63H 9/00* (2006.01)
*A47L 3/04* (2006.01)

(52) U.S. Cl. ..... 114/39.18; 182/3

(58) Field of Classification Search ..... 114/39.18
See application file for complete search history.

(56) References Cited

U.S. PATENT DOCUMENTS

| | | | | |
|---|---|---|---|---|
| 3,034,596 A | | 5/1962 | Twaits, Jr. | |
| 4,112,865 A | | 9/1978 | Carn | |
| 4,378,614 A | * | 4/1983 | McKenney | 441/75 |
| 4,588,044 A | * | 5/1986 | Mader | 182/3 |
| 6,932,301 B2 | * | 8/2005 | Green | 244/155 A |

FOREIGN PATENT DOCUMENTS

| | | |
|---|---|---|
| DE | 19936624 A1 | 2/2001 |
| FR | 2345172 | 10/1977 |
| FR | 2521519 | 8/1983 |

* cited by examiner

*Primary Examiner*—Jesús D. Sotelo
(74) *Attorney, Agent, or Firm*—Wenderoth, Lind & Ponack, L.L.P.

(57) ABSTRACT

A safety system of a harness, in particular of the trapezoidal type, is suitable for use on watercraft such as a yacht or windsurfer. A basic element (10) is coupled to the harness. A hook (15), suitable for being hooked by a cable, is coupled to the basic element (10). The basic element (10) has a first piece (31) connected to the harness and a second piece (30, 15) that can be disconnected from said first piece (31). The first piece (31) is coupled to the second piece (30, 15) by a coupling (32) that can be removed.

14 Claims, 3 Drawing Sheets

HARNESS SUITABLE FOR USE ON WATERCRAFT

BACKGROUND OF THE INVENTION

The present invention refers to a harness, in particular of the trapezoidal type, suitable for use on watercraft such as yachts or windsurfers. More specifically it refers to a safety system of the harness.

When a boat leans over on one side because of the wind or the speed that has to be kept, it is usual for sailors to lean over the side of the boat to compensate for the inclination using their own weight. The trapezoidal type of harnesses are used, which can be connected to cables connected to the mast of the boat, to allow the sailors to lean over as much as possible without falling into the water.

It can happen, though, that in the event of danger, for example if the boat capsizes, it is difficult if not impossible to unhook the cable of the harness sometimes resulting in disastrous consequences for the sailors.

SUMMARY OF THE INVENTION

In view of the state of the art as described, the object of the present invention is to provide a safety system for unhooking the harness from the cable.

In accordance with the present invention, this object is achieved by means of a harness suitable for use on watercraft comprising a basic element coupled to the harness and a hook, suitable for being hooked to a cable, coupled to the basic element. The basic element comprises a first piece connected to the harness and a second piece that can be disconnected from the first piece. The first piece is coupled to the second piece by means of a coupling means that can be removed. Thanks to the present invention, a safety system can be made for unhooking the harness from the cable and which can be installed on all models of the trapezoidal type of harness without making any modifications and just by replacing the hooking plate. Further, this system is of easily realization and low cost because it comprises simple mechanical parts, of which one is disconnectable from the harness in case of necessity.

BRIEF DESCRIPTION OF THE DRAWINGS

The characteristics and advantages of the present invention will appear evident from the following detailed description of some of its embodiments, illustrated as non-limiting examples in the enclosed drawings, in which.

DETAILED DESCRIPTION OF THE PREFERRED EMBODIMENTS

Figure 1:
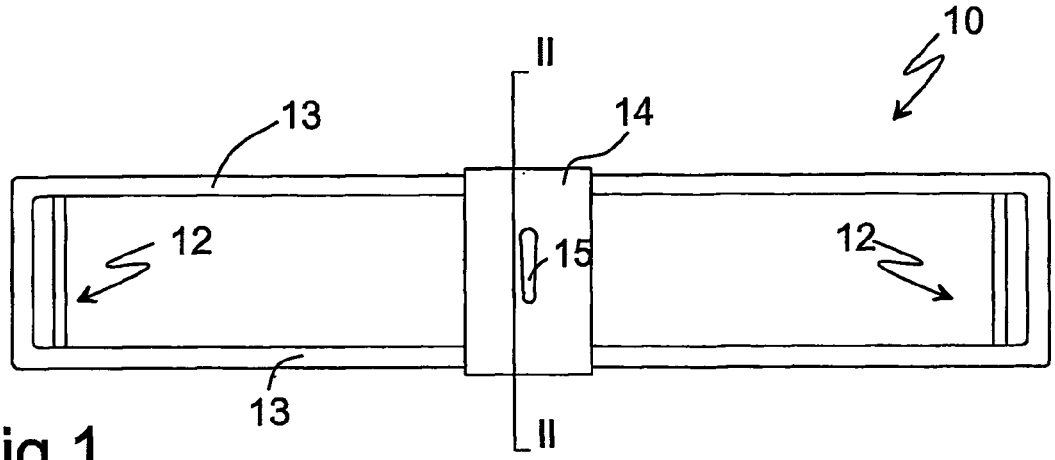
FIG. 1 represents a plate for hooking the cable of a trapezoidal harness in accordance with the known art.
Figure 2:
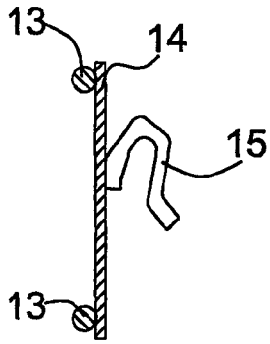
FIG. 2 represents a section of FIG. 1 according to line II-II.

We now refer to FIG. 1, in which a hooking plate 10 of the cable of a trapezoidal harness is shown in accordance with the known art, and to FIG. 2, which represents a section of FIG. 1 according to line II-II.

The hooking plate 10, normally constituted by a tubular metal structure 13 of a rectangular shape, comprises suitable means 12 and 13 for fastening it, by means of suitable belts (not shown), to the harness (not shown) that will be worn by the sailor.

A plate 14, onto which a hook 15 is welded, is welded at the center of the hooking plate 10. A ring of a cable (not shown) fastened onto the mast of the boat will be hooked onto the hook 15.

Figure 3:
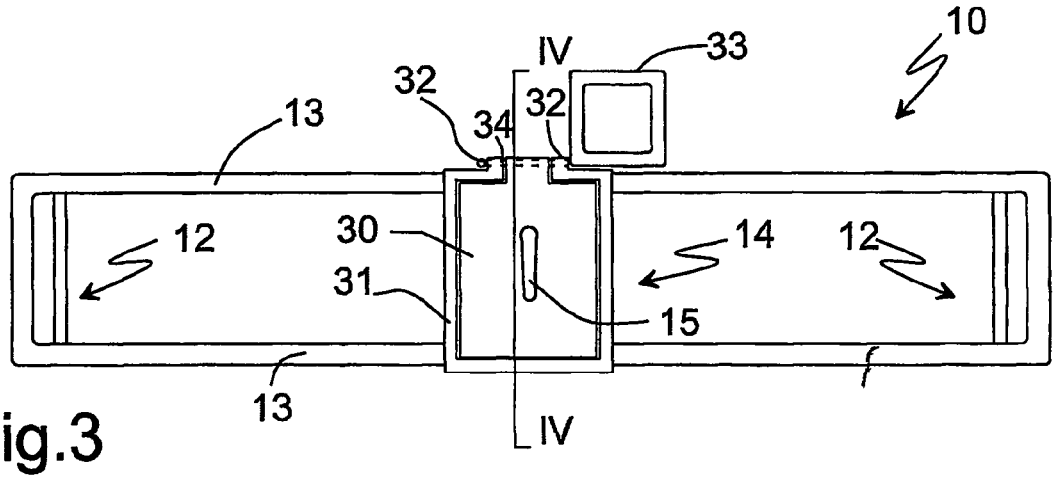
FIG. 3 represents a plate for hooking the cable of a trapezoidal harness, in the closed position, in accordance with a first embodiment of the present invention.

We now refer to FIG. 3, in which a hooking plate 10 of the cable of a trapezoidal harness is shown, in a closed position, in accordance with a first embodiment of the present invention.

In FIG. 3 elements similar to the elements of FIG. 1 have the same numerical reference.

The plate 14 comprises in this case a first plate 31 fastened onto the tubular metal structure 13 for example by means of welding. A second plate 30, on which the hook 15 is fastened, is engaged with the first plate 31. They are fastened to each other so that they can be separated, by means of a pin 32 that comprises a ring 33 to facilitate its removal, which pin is positioned in a hole 34 made in the upper part both of the plate 31 and of the plate 30. The ring 33 forms a manual grip for removal control.

Figure 4:
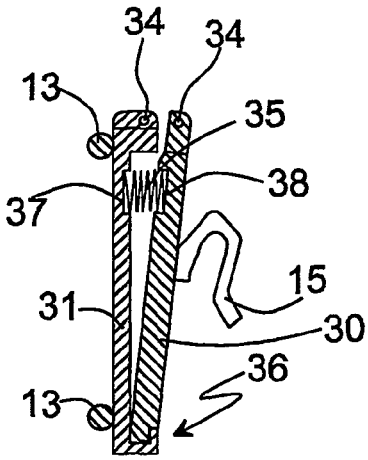
FIG. 4 represents a section of FIG. 3 according to line IV-IV, in the open position.
Figure 5:
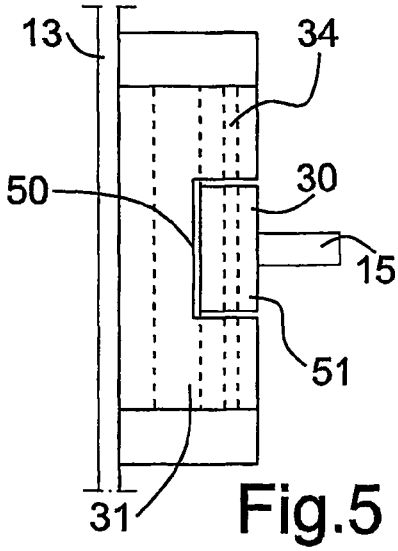
FIG. 5 represents a hooking plate seen from above the cable of a trapezoidal harness, in the closed position, in accordance with a first embodiment of the present invention.

We now refer to FIG. 4 that represents a section of FIG. 3 according to line IV-IV, in the open position, and to FIG. 5 that represents a hooking plate seen from above the cable of a trapezoidal harness, in the closed position, in accordance with a first embodiment of the present invention.

The plate 31, in its lower part, in correspondence with reference 36, has a U-shaped tooth in which the plate 30 (preferably with the internal corner rounded-off) is rested.

In the upper part, the plate 31 has a central cavity 50 in which a portion 51 of the plate 30 can lie. In other words, the plate 31 in the upper part has two side portions with a greater thickness compared to the other parts, thus forming a central hollow, and the plate 30 has in the upper part a vertical central protrusion that can fit into the hollow of the plate 31.

In this manner, when the plates 30 and 31 are brought closer together, the hole 34 on the plate 30 and on the plate 31 are aligned and the locking pin 32 can be inserted.

Preferably, the dimensions of these parts of the structure have a dimension which is sufficient for the hole 34 to be made so that the pin 32 can be inserted.

A spring 35 is preferably positioned between the plate 31 and the plate 30, and a housing 37 and 38 of the spring 35 is preferably made in both plates.

With plates closed, the pin 32 on one side and the tooth in position 36 hold the plate 30 against the plate 31.

In the event the harness has to be unhooked, the pin 32 is pulled out by pulling the ring 33 from the side and the plate 30 is pushed out by the action of the spring 35 to free it from the plate 31, thus freeing the cable fastened to the hook 15 from the harness worn by the sailor.

The type of material preferred for the system described above is high corrosion resistant stainless steel (for example INOX18/10, or AISI 316L), given its use in the presence of saltwater.

The maximum load that can be applied to the hook will be equal to the weight of the athlete, shall we say a maximum of 100 kg (about 1 kN). This is a negligible load for a steel structure of preferably 7 mm. A shear force of 1 kN, on a circular steel structure of 7 mm in diameter leads to a maximum internal stress of about 26 Mpa, low compared to the critical value of almost 1 Gpa for steel.

In regard to the stress to be placed on the ring 33 for unhooking, the following theories can be formulated. The load applied to the hook is distributed entirely on the contact of the pin. A linear contact between the locking pin and guide is made. The coefficient of static friction to the steel-steel contact is equal to 0.2. Thus the force to be applied to slip the pin out in this case will be equal to about 200N (about 20 kg-force); normally an athlete can develop much greater traction forces with the shoulder-arm muscle group, and thus the pin can be slipped out without problems.

The locking pin 32 and the hole 34 have such a dimension that the pin 32 presents slight friction with the hole 34, so that it cannot come out unless it is purposely extracted by means of the ring 33. Preferably, at the end opposite the ring 33, the pin 32 can be fitted with a fine lead wire, also with a lead seal, that places minimum resistance to the pin coming out, but which prevents the pin 32 from accidentally coming out of its housing.

Figure 6:
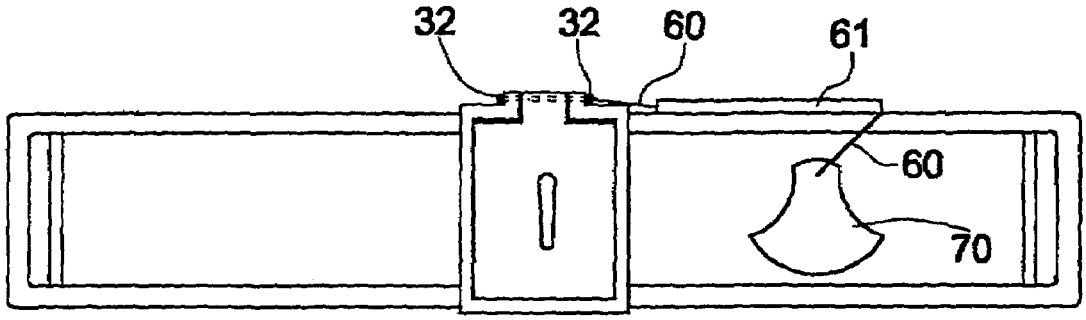
FIG. 6 represents a plate for hooking the cable of a trapezoidal harness, in the closed position, in accordance with a second embodiment of the present invention.
Figure 7:
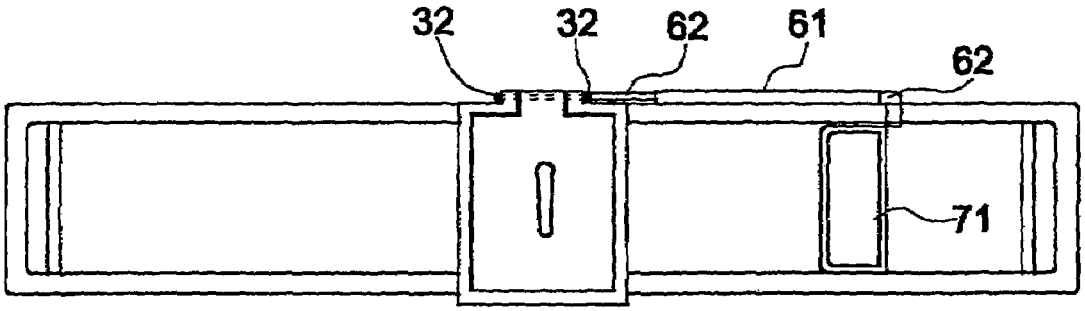
FIG. 7 represents a plate for hooking the cable of a trapezoidal harness, in the closed position, in accordance with a third embodiment of the present invention.
Figure 8:
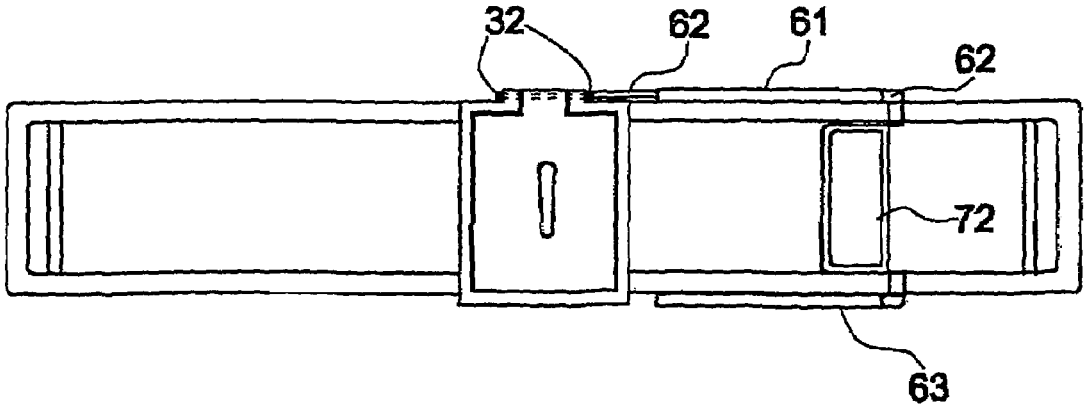
FIG. 8 represents a plate for hooking the cable of a trapezoidal harness, in the closed position, in accordance with a fourth embodiment of the present invention.

In FIGS. 6, 7 and 8 plates for hooking the cable of a trapezoidal harness are shown, in the closed position, in accordance with different embodiments.

In FIG. 6 the ring 33, connected to the pin 32, has been replaced by a cable 60 that slides in a tubular guide 61, comes out of it and ends fastened to a flying handle 70.

In FIG. 7 the pin 32 is connected to a rigid slug 62 that slides in a tubular guide 61 and is fastened to a handle 71, suitably positioned on the tubular metal structure 13.

In FIG. 8, in relation to FIG. 7, there is another tubular guide 63 to permit the handle 72 to slide more smoothly.

Figure 9:
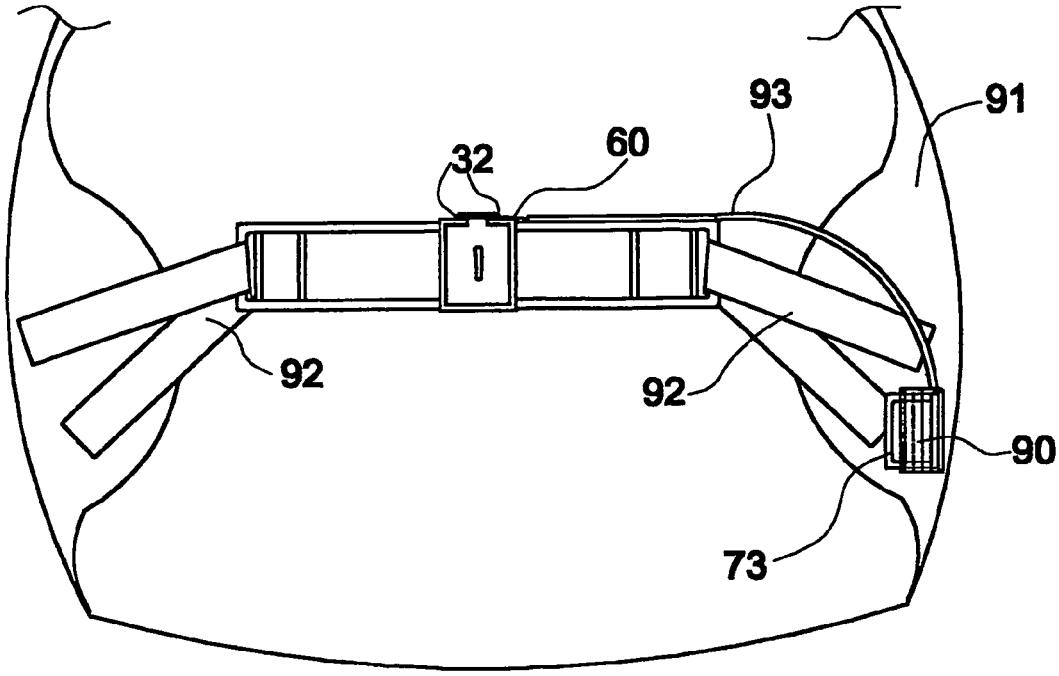
FIG. 9 represents a plate for hooking the cable of a trapezoidal harness, in the closed position, in accordance with a fifth embodiment of the present invention, with a partial view of the harness.

In FIG. 9, similarly to FIG. 6, the pin 32 is connected to a cable 60 that slides in a flexible tubular guide 93, fastened to a flying handle 73, inserted in a pocket 90, preferably provided with Velcro to prevent it from coming out accidentally. In FIG. 9 a partial view of the harness 91 is also shown with some belts 92 that fasten the hooking plate 10 to the harness itself.

Figure 10:
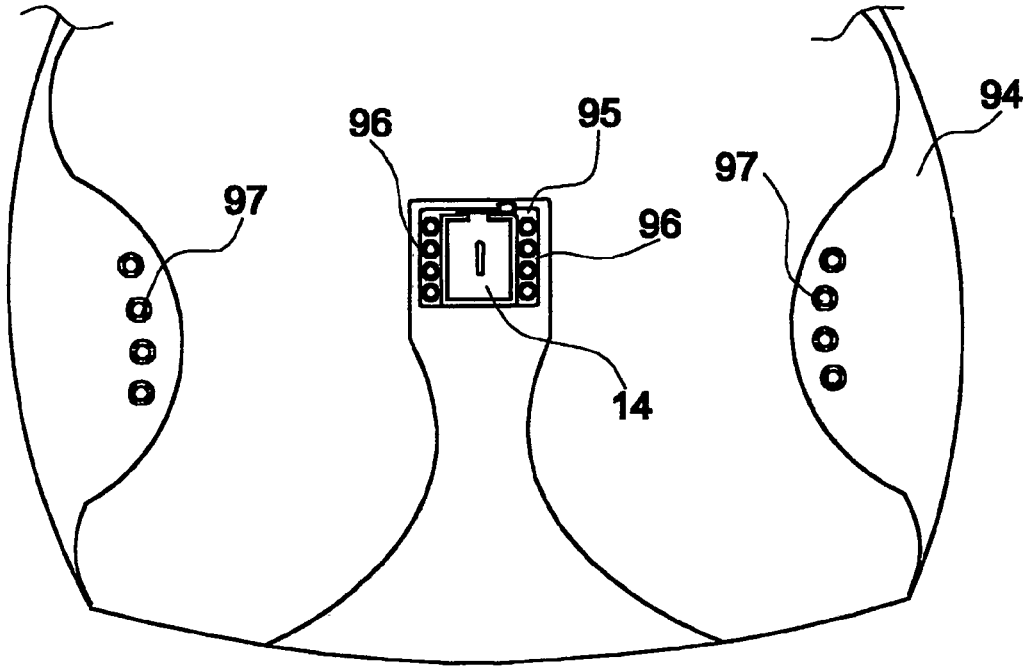
FIG. 10 represents a plate for hooking the cable of a harness, in the closed position, in accordance with a sixth embodiment of the present invention, with a partial view of the harness.

FIG. 10 shows a type of harness 94 that is slightly different from the harness 91 of FIG. 9, being the type typically used for windsurfing.

Instead of the tubular metal structure 13, in this case, there is a plate 95 fastened to the fabric of the harness 94 below. The plate 14 is fastened onto the plate 95. On the plate 95 there are also, on the side of the plate 14, two rows of holes 96 that serve to fasten the plate 95 onto the fabric of the harness 94. The holes 96 in combination with the holes 97, positioned on the harness 94, also serve to close the harness 94 itself by means of a cord.

Several embodiments of the present invention have been described, but others are also possible. All the embodiments described up to this point have the closing pin 32 positioned in the upper part and the tooth in position 36 positioned in the lower part, but alternatively they could be inverted. That is, use the hooking plates 10 could be used upside down in relation to the Figures.

Alternatively, the plate 30 and the plate 31 could be hooked only by means of the pin 32 without using the tooth on the plate 31 in position 36, possible suitably positioning the hook 15 and the pin 32 on the plates 30 and 31.

In addition the hollow portion 50 and the portion 51 of the plate 30 could be more than one.

As an alternative, to lighten the weight, a structure, preferably full of composite material, for example of carbon, Kevlar and epoxy resins, can be used as the tubular structure 13. The plate 30 and the pin 32 could still be constituted of steel.

The invention claimed is:

1. A harness arrangement suitable for use on water craft, comprising:

a basic element coupled to a harness; and a hook, suitable for hooking a cable, coupled to said basic element;

wherein said basic element comprises a first piece connected to said harness and a second piece that can be disconnected from said first piece;

wherein said first piece is coupled to said second piece by a removable coupling member; and wherein a spring is positioned between said first piece and said second piece.

2. A harness arrangement suitable for use on water craft, comprising:

a basic element;

means for connecting said basic element to a harness adapted to be used on water craft;

wherein said basic element comprises: a first piece comprising said means for connecting said basic element to a harness; and a second piece that can be disconnected from said first piece;

a hook, suitable for hooking a cable of the water craft, fixed with respect to said second piece; and a removable coupling member that is operable to couple said first piece to said second piece and that is removable from said first piece and said second piece to uncouple said second piece from said first piece, said removable coupling member having a manual grip for removal control.

3. The harness of claim 2, wherein said first piece and said second piece are constituted of plates.

4. The harness of claim 2, wherein said first piece comprises at least one hollow portion in which at least one portion of said second piece can be placed.

5. The harness of claim 2, wherein said first piece and said second piece have a transverse through hole in which said coupling member can be inserted.

6. The harness of claim 5, wherein said coupling member comprises a pin that can be slid out of said though hole.

7. The harness of claim 6, wherein said pin has a handle for sliding said pin out of said through hole.

8. The harness of claim 5, further comprising a guide track for sliding said pin out of said through hole.

9. The harness of claim 2, wherein said coupling member is positioned in an upper part of said first piece and said second piece.

10. The harness of claim 2, wherein said first piece comprises a tooth with which said second piece is engaged.

11. The harness of claim 10, wherein said tooth is positioned at a lower part of said first piece.

12. The harness of claim 2, wherein said second piece comprises said hook.

13. The harness of claim 12, wherein said hook, said first piece and said second piece are made of steel.

14. The harness of claim 2, wherein said harness is of a trapezoidal type.

* * * * *